US005243916A

United States Patent [19]

Freche et al.

[11] Patent Number: 5,243,916

[45] Date of Patent: Sep. 14, 1993

[54] EXPLOSIVE MUNITION COMPONENT OF LOW VULNERABILITY, COMPRISING A DUAL COMPOSITION EXPLOSIVE CHARGE AND PROCESS FOR OBTAINING A FRAGMENTATION EFFECT

[75] Inventors: Alain Freche, Paris Cedex; Bruno Nouguez, Vert le Petit, both of France

[73] Assignee: Societe Nationale des Poudres et Explosifs, Paris, France

[21] Appl. No.: 900,481

[22] Filed: Jun. 18, 1992

[30] Foreign Application Priority Data

Jun. 26, 1991 [FR] France ..... 91 07851

[51] Int. Cl.[5] ..... F42B 12/20; F42B 39/00

[52] U.S. Cl. ..... 102/481; 102/473; 102/491

[58] Field of Search ..... 102/283, 285, 286, 287, 102/288, 305, 389, 473, 475, 478, 481, 491–497, 701, 289, 306–310, 476

[56] References Cited

U.S. PATENT DOCUMENTS

| | | | |
|---|---|---|---|
| 37,661 | 2/1863 | Gerardin | 102/496 |
| 2,669,182 | 2/1954 | Weiss . | |
| 3,908,364 | 9/1975 | LaFebvre et al. | 102/283 |
| 3,918,365 | 11/1975 | Arribat | 102/287 |
| 3,926,697 | 12/1975 | Humbert et al. | 102/288 |
| 4,170,940 | 7/1977 | Precoul . | |
| 4,305,324 | 12/1981 | Precoul . | |
| 4,627,353 | 12/1986 | Chawla . | |
| 5,054,399 | 10/1991 | Bilek et al. | 102/481 |

FOREIGN PATENT DOCUMENTS

| | | | |
|---|---|---|---|
| 796861 | 4/1936 | France . | |
| 2365774 | 4/1978 | France . | |
| 2502768 | 10/1982 | France . | |
| 133856 | 5/1961 | Sweden | 102/491 |
| 2214618 | 9/1989 | United Kingdom . | |

OTHER PUBLICATIONS

"Insensitive Munitions—A Fire Safety Plus?", Military Fire Fighter, May 1989, pp. 74 to 81.

J. Quinchon et al, "Les poudres, propergols et explosifs", Tome1: Les explosifs, technique et documentation, 1982—pp. 190–192.

*Primary Examiner*—Harold J. Tudor

*Attorney, Agent, or Firm*—Cushman, Darby & Cushman

[57] ABSTRACT

The present invention relates to an effective and explosive munition component of low vulnerability, consisting of a casing 1 containing an explosive charge consisting of an internal layer 2 made of plastic bonded explosive in which the filler contains at least one organic nitrated explosive, coated with a peripheral adjacent coaxial layer 3 made of less sensitive pyrotechnic composition consisting of a filled polymeric matrix in which the filler contains at least one inorganic oxidizing agent or an organic nitrated explosive.

The interface between the two layers 2 and 3 is of star-shaped cross-section.

The invention also relates to the process for obtaining a fragmentation effect by detonation of the layer 2, reaction of the layer 3 followed by bursting of the casing due to the pressure of the gases formed.

16 Claims, 1 Drawing Sheet

EXPLOSIVE MUNITION COMPONENT OF LOW VULNERABILITY, COMPRISING A DUAL COMPOSITION EXPLOSIVE CHARGE AND PROCESS FOR OBTAINING A FRAGMENTATION EFFECT

The present invention relates to the field of munitions, especially military ones, with attenuated hazards. It relates to an explosive munition component of low vulnerability, consisting of a generally metallic casing containing an explosive charge. These munitions are especially useful for generating a fragmentation effect when the casing bursts. The charge and its casing generally have an axial symmetry so as to generate symmetric effects. The explosive munitions, especially when being stored or transported, can be subjected to attacks such as fire, impact and entry of fragments or bullets and nearby detonation of neighboring munitions.

BACKGROUND OF THE INVENTION

While the problems of fire and of fragments can be solved in practice with the aid of traditional compound explosives, the problem of sympathetic detonation, more precisely of vulnerability to the nearby detonation of neighboring munitions, has not yet been solved in a satisfactory manner. It is well known to employ plastic bonded explosives, especially cast plastic bonded explosives of particularly low sensitivity filled, for example, with 5-oxo-3-nitro-1,2,4-triazole (ONTA), with triaminotrinitrobenzene (TATB) or nitroguanidine. However, this solution has a major disadvantage, namely that the vulnerability of the munition to nearby detonation of neighboring munitions is then dependent on that of the initiation system. Now, these low-sensitivity plastic bonded explosives generally have a large critical diameter which may exceed 10 cm, and can be initiated conventionally only by a powerful relay of large size, and therefore particularly sensitive and vulnerable.

A plastic bonded explosive is conventionally intended to mean a pyrotechnic composition capable of being functionally detonated, consisting of a filled solid polymeric matrix, generally filled polyurethane or polyester, the filler being pulverulent and containing an organic nitrated explosive charge, for example Hexogen, Octogen, ONTA or a mixture of at least two of these compounds. The cast plastic bonded explosives and the manner in which they are obtained are described, for example, by J. Quinchon, "Les poudres, propergols et explosifs" [Powders, propellants and explosives], volume 1, Les explosifs, Technique et Documentation, 1982, pages 190–192.

French Patent FR 2,365,774 describes an approximately cylindrical component of explosive munition, consisting of a casing containing a multicomposition charge which may be a plastic bonded explosive. This multicomposition charge comprises a plurality of adjacent coaxial annular layers, the peripheral layer having a content of powerful heavy explosive (Hexogen, Octogen) which is higher than that of the layer immediately adjacent to it and thus step by step until the central axial layer, which is fully cylindrical, and, comprises the lowest content of powerful heavy explosive. Such an explosive munition component is therefore particularly vulnerable.

Furthermore, the article "Insensitive Munitions-A fire safety plus?" which appeared in May 1989 in the review "Military Fire Fighter" pages 74 to 81, teaches that the vulnerability of a munition component filled with sensitive plastic bonded explosive can be reduced by coating this explosive with a less sensitive plastic bonded explosive, the twin-composition charge being in the form of 2 adjacent coaxial cylinders with a circular base surface.

The less sensitive plastic bonded explosives are, however, less effective and the reduction in the vulnerability of the munition component is accompanied by a drop in performance. Experimental tests carried out by the applicants, forming the subject of Comparative Examples 3 to 5 of the present description, have even shown that the fragmentation effect of such a munition component could be reduced to the level of that obtained with a munition component of the same size but filled solely with the less vulnerable and less effective coating plastic bonded explosive.

The person skilled in the art seeks therefore an improvement in relation to this munition component comprising a dual-composition charge which makes it possible to increase the fragmentation effect while maintaining the same degree of invulnerability.

The present invention proposes such a solution.

It has been found, unexpectedly, that if the interface between the two compositions, along a cross-section in relation to the axis of the charge, is in the shape of a star, instead of being circular as according to the state of the art, a gain, sometimes very large, is obtained in the fragmentation effect and that, according to certain alternative forms —which is even more surprising—the degree of fragmentation effect obtained is equal to that obtained with a munition component of the same size, filled solely with the effective sensitive central plastic bonded explosive. This star-shaped configuration has no effect on the invulnerability which is maintained, while the degree of the fragmentation effect is improved, and while, according to certain alternative forms, everything behaves even as if the charge were made up completely of the effective central explosive.

It has also been found that such an improvement is also obtained when the sensitive and vulnerable central plastic bonded explosive is coated, along a star-shaped interface, not with a less sensitive plastic bonded explosive but with a pyrotechnic composition of the class of composite solid propellants which is still less sensitive and vulnerable than the least sensitive known plastic bonded explosives, sometimes referred to as "insensitive" ones.

This is all the more surprising, since this result, already surprising when all the charge detonates, is obtained while the pyrotechnic composition of the class of the composite solid propellants reacts without detonating.

This alternative form of the invention is all the more advantageous since it makes it possible at the same time to lower the vulnerability and to increase the fragmentation effect in comparison with the dual-composition component made of plastic bonded explosive of the abovementioned state of the art in the article "Insensitive munitions".

SUMMARY OF THE INVENTION

The present invention relates therefore to an explosive munition component consisting of a casing which is preferably metallic but which may be made of another material, for example a rigid plastic, containing a dual-composition explosive charge consisting of an internal layer made of plastic bonded explosive coated with a peripheral adjacent coaxial layer made of a pyrotechnic composition which is less sensitive than the plastic bonded explosive forming the internal layer. It is characterised in that:

the plastic bonded explosive forming the internal layer is a filled polymeric matrix, preferably filled polyurethane or polyester, in which the filler contains at least one organic nitrated explosive, preferably more than 20% by weight of organic nitrated explosive, the percentage being expressed in relation to the plastic bonded explosive, the pyrotechnic composition forming the peripheral layer consists of a filled polymeric matrix, preferably filled polyurethane or polyester, in which the filler contains at least one inorganic oxidizing agent or an organic nitrated explosive, the interface between the two layers has a star-shaped cross-section, that is to say that along a section plane perpendicular to the axis of the charge the interface is star-shaped in form. This also is equivalent to saying that the cross-section of the internal layer represents a star, namely a figure made up of arms which radiate from a central point or a central region.

Given that aliphatic nitrated derivatives have never yet given rise to any major industrial application as an explosive, an "organic nitrated explosive" is conventionally intended to mean an explosive chosen from the group consisting of aromatic nitrated explosives (containing at least one C—$NO_2$ group, the carbon atom forming part of an aromatic ring), nitric ester explosives (containing at least one C—O—$NO_2$ group) and nitramine explosives (containing at least one C—N—$NO_2$ group). Furthermore, a pyrotechnic composition "less sensitive" than the plastic bonded explosive forming the internal layer is intended to mean a pyrotechnic composition which has a detonability value (DV) acccording to the test for detonability behind a barrier (Card Gap Test) lower than that of the plastic bonded explosive forming the internal layer.

This test, standardized either at a 40-mm diameter or at a 75-mm diameter, is well known to a person skilled in the art. It is described especially in the publication "Recommendations for the transportation of dangerous goods". 2nd edition ST/SG/AC 10/11 Rev. 1. UNO publications. New York, 1990. Furthermore, J. Quinchon describes the test at 40-mm diameter in his abovementioned work, pages 227 to 229.

According to the invention the internal and peripheral layers of the charge are preferably cylindrical. They may be not strictly coaxial if the intention is to create a dissymmetry in the fragmentation effects. However, the interest is very limited.

The internal layer/external layer mass ratio is preferably between 0.1 and 2.

The internal layer of plastic bonded explosive is preferably solid, but it may also have one or more cavities, for example an axial cavity, partial or over the whole length of the charge. Such a cavity may, for example, allow the initiating system to be housed.

Within the scope of the present invention the polymeric matrices of the internal and peripheral layers, which are identical or different, are preferably polyurethanes generally obtained by reaction of a prepolymer containing hydroxyl ends with a polyisocyanate.

As examples of prepolymers with hydroxyl ends there may be mentioned those whose backbone is a polyisobutylene, a polybutadiene, a polyether, a polyester or a polysiloxane. A polybutadiene with hydroxyl ends is preferably employed.

As examples of polyisocyanates there may be mentioned isophorone diisocyanate (IPDI), toluene diisocyanate (TDI), dicyclohexylmethylene diisocyanate (Hylene W), hexamethylene diisocyanate (HMDI), biuret trihexane isocyanate (BTHI) and mixtures thereof.

When the polymeric matrix is a polyester matrix it is generally obtained by reaction of a prepolymer with carboxyl ends, preferably a polybutadiene with carboxyl ends (CEPB) or a polyester with carboxyl ends, with a polyepoxide, for example a condensate of epichlorohydrin and glycerol, or a polyaziridine, for example trimethylaziridinylphosphine oxide (MAPO).

The polymeric matrices may optionally include a plasticiser, such as those usually employed in the processing of plastic bonded explosives and of composite solid propellants.

According to another alternative form of the invention the interface between the two layers has a star-shaped cross-section which has 6 to 24 arms.

The end of the arms of the star may be of any shape. These ends are preferably pointed, flat or rounded.

The star-shaped interface may be rigorously polygonal or may have connecting grooves between arms.

The arms of the star are preferably identical, have an axis of symmetry running through the center of the star and, if n is the number of arms, each arm is separated from the neighboring arms by an angle of $2\pi/n$.

According to the invention the plastic bonded explosive filler forming the internal layer contains at least one organic nitrated explosive, preferably more than 20%, still better more than 60%, by weight of organic nitrated explosive, expressed relative to the plastic bonded explosive, and the filler of the pyrotechnic composition forming the peripheral layer contains at least one inorganic oxidizing agent or an organic nitrated explosive.

Examples of inorganic oxidizing agent which may be mentioned are ammonium perchlorate, potassium perchlorate, ammonium nitrate and sodium nitrate.

Examples of organic nitrated explosive which may be mentioned are Hexogen, Octogen, pentrite, 5-oxo-3-nitro-1,2,4-triazole, triaminotrinitrobenzene and nitroguanidine.

According to a preferred alternative form the internal layer is a plastic bonded explosive consisting of a filled polyurethane or polyester matrix in which the filler contains more than 20% by weight, expressed in relative to the plastic bonded explosive, of organic nitrated explosive chosen from the group consisting of hexogen, octogen, 5-oxo-3-nitro-1,2,4-triazole and mixtures thereof.

In a particularly preferred manner, the filler of the plastic bonded explosive forming the internal layer consists solely of the organic nitrated explosive, preferably between 60% and 90%, still better between 80% and 90%, the percentages being expressed relative to the plastic bonded explosive.

According to another alternative form of the invention the pyrotechnic composition forming the peripheral layer is a plastic bonded explosive, preferably consisting of a filled polyurethane or polyester matrix in which the filler contains more than 20% by weight, expressed relative to the plastic bonded explosive, of an organic nitrated explosive preferably chosen from the group consisting of hexogen, octogen, pentrite, triaminotrinitrobenzene, nitroguanidine, 5-oxo-3-nitro-1,2,4-triazole and mixtures thereof.

The filler may also include, for example, an inorganic oxidizing agent and/or a reducing metal, but preferably the filler of the plastic bonded explosive forming the peripheral layer consists solely of the organic nitrated explosive, preferably between 60% and 90%, still better between 80% and 90%, the percentages being expressed relative to the plastic bonded explosive.

According to another alternative form of the invention the pyrotechnic composition forming the peripheral layer is a pyrotechnic composition of the class of composite solid propellants, consisting of a filled polyurethane or polyester polymeric matrix in which the filler, free from organic nitrated explosive, contains at least one inorganic oxidizing agent.

A "composite solid propellant" is, conventionally, intended to mean a pyrotechnic composition obtained identically with that of a cast plastic bonded explosive and consisting of a filled solid polymeric matrix, generally polyurethane or polyester, the said filler being pulverulent and consisting essentially of an inorganic oxidizing agent and generally of a reducing metal. Being destined for propulsion, composite solid propellants are functionally combustible and include various additives for controlling the propulsion. Composite solid propellants and the way in which they are obtained are described, for example, by A. Davenas, Technologie des propergols solides, publ. Masson, 1989.

According to this alternative form of the present invention, since the propellant function is neither sought after nor exercised, the applicants wish not to refer to the peripheral layer as "propellant", although the composition of this layer differs from that of composite solid propellants only in the absence of the additives linked with the propellant function of the propellants ballistic additives, combustion accelerators and the like), and prefer to employ the expression "pyrotechnic composition of the group of composite solid propellants".

According to an alternative form, the filler of the pyrotechnic composition of the class of composite solid propellants forming the peripheral layer contains an inorganic oxidizing agent chosen from the group consisting of ammonium perchlorate, potassium perchlorate, ammonium nitrate, sodium nitrate and mixture thereof, that is to say any mixtures of at least two of the abovementioned products.

According to another alternative form the filler of the pyrotechnic composition of the class of composite solid propellants forming the peripheral layer contains a reducing metal preferably chosen from the group consisting of aluminum, zirconium, magnesium, boron and mixtures thereof, that is to say any mixtures of at least two of the four abovementioned metals. In a particularly preferred manner the reducing metal is aluminum.

According to another alternative form the filler of the pyrotechnic composition forming the peripheral layer is an inorganic filler, preferably chosen from the group consisting of ammonium perchlorate, potassium perchlorate, ammonium nitrate, sodium nitrate and mixtures thereof. The filler therefore does not contain any other compound.

According to another alternative form the filler of the pyrotechnic composition forming the peripheral layer consists, and consists solely, of a mixture of a reducing metal preferably chosen from the group consisting of aluminum, zirconium, magnesium, boron and mixtures thereof, and of an inorganic oxidizing agent preferably chosen from the group consisting of ammonium perchlorate, potassium perchlorate, ammonium nitrate, sodium nitrate and mixtures thereof. The filler is preferably a mixture of ammonium perchlorate and aluminum.

According to the alternative form of the invention wherein the peripheral layer is a pyrotechnic composition of the class of composite solid propellants, this composition preferably consists of:

10% to 40% by weight of a polyurethane or polyester polymeric matrix, 0 to 40% by weight of a reducing metal, 20% to 90% by weight of an inorganic oxidizing agent, the sum of the percentages being equal to 100.

In general, according to the present invention, the term "dual-composition" referring to the explosive charge should not be taken in a strict and limiting sense. The technical effect found and the results stemming therefrom remain when the internal layer and/or the peripheral layer is itself of twin or multicomposition, with conventional interfaces which are not star-shaped between layers, or else when a number of interfaces are star-shaped, for example in the case of a sensitive plastic bonded explosive coated with a less sensitive plastic bonded explosive with a star-shaped interface, the block thus formed being itself coated with a virtually insensitive pyrotechnic composition of the class of composite solid propellants, the second interface being also star-shaped.

A further subject of the present invention is a process for obtaining a fragmentation effect by gas release in the casing of an explosive munition component, consisting of a casing containing a dual-composition explosive charge followed by bursting of the casing due to the pressure of the gas formed. This process is characterized in that the explosive munition component is an abovementioned component according to the invention and in that the gas release is obtained by detonation of the plastic bonded explosive forming the internal layer of the charge, followed by reaction of the less sensitive pyrotechnic composition forming the peripheral layer, the reaction being initiated by the detonation wave from the plastic bonded explosive forming the internal layer.

When the peripheral layer is a plastic bonded explosive, it also detonates. On the other hand, when the peripheral layer is a pyrotechnic composition of the class of composite solid propellants, it reacts without detonating.

DETAILED DESCRIPTION

Figure 1:
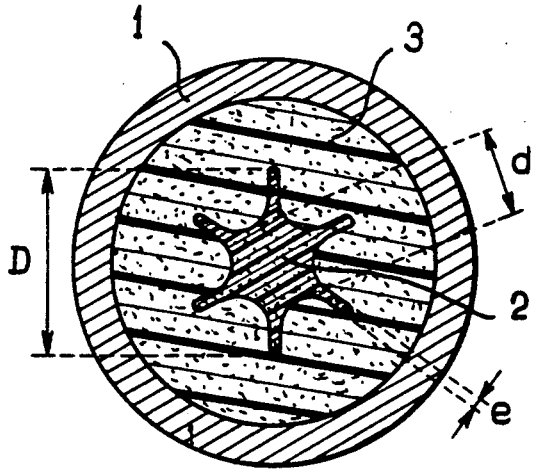
FIG. 1 shows a diagrammatic cross-section at right angles of a low-vulnerability component of explosive munition according to the invention.
Figure 2:
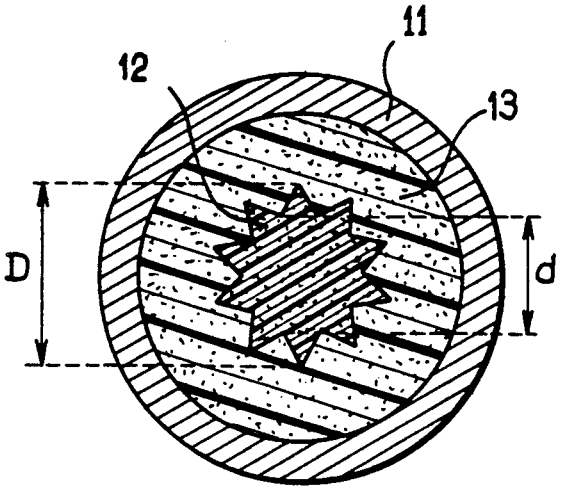
FIG. 2 shows a diagrammatic cross-section at right angles of another low-vulnerability component of explosive munition according to the invention.

In the embodiments shown diagrammatically in FIGS. 1 and 2 the explosive munition component consists of a cylindrical steel casing 1, 11, with a circular base surface containing a dual-composition explosive charge consisting of an internal layer 2, 12 made of plastic bonded explosive coated with a peripheral layer 3, 13 made of pyrotechnic composition which is less sensitive than the plastic bonded explosive forming the internal layer 2, 12.

According to FIG. 1 the interface between the layers 2 and 3 is of a star-shaped form with 6 symmetrical identical arms which are joined by connecting grooves and the ends of which are rounded. Each arm is separated from the neighboring arms by an angle of 60 degrees. The dimensions of the star can be defined by its circumscribed circle of diameter D, its inscribed circle of diameter d and by the thickness e of the arms.

According to FIG. 2 the star-shaped interface is rigorously polygonal. The star is formed by 10 identical and symmetrical arms whose ends are pointed. Each arm is separated from the neighboring arms by an angle of 36 degrees. The dimensions of the star can be defined by its circumscribed circle of diameter D and its inscribed circle of diameter d.

The following nonlimiting examples illustrate the invention and the advantages which it provides.

EXAMPLE 1 and 2

EXPLOSIVE MUNITION COMPONENTS ACCORDING TO THE INVENTION

Example 1

This example was produced according to FIG. 1. The casing 1, 12.5 mm in thickness, is made of steel. Its outer diameter is 115 mm and its inner diameter 90 mm. Its length is 300 mm. The casing 1 has a bottom, also made of steel, with a thickness of 12.5 mm.

The abovementioned geometric characteristics of the star, D, d and e, are 50 mm, 23 mm and 3 mm respectively.

The internal layer 2, solid, is a cast plastic bonded explosive composed of 86% by weight of octogen and 14% by weight of a polyurethane polymeric matrix obtained by reaction of a polyether with hydroxyl ends with isophorone diisocyanate (IPDI). This composition, which is effective since its detonation velocity is 8300 m/s, is, however, sensitive, since its detonability value DV is 150 cards according to the Card Gap Test, standardized at 40-mm diameter.

The peripheral layer 3 is a cast plastic bonded explosive composed of 12% by weight of octogen, 72% by weight of 5-oxo-3-nitro-1,2,4-triazole and 16% by weight of a polyurethane polymeric matrix obtained by reacting a polybutadiene with hydroxyl ends with IPDI. This peripheral composition is less effective (detonation velocity 7440 m/s) and considerably less sensitive (DV of 25 cards according to the Card Gap Test standardized at 40-mm diameter) than the internal composition.

The initiation of the layer 2 was carried out with the aid of a conventional detonator, which is a small relay with a 4-g mass of hexowax and with a planar wave generator (PWG) having a 76-mm diameter as a main relay. The detonation wave of the internal layer 2 resulted in the detonation of the peripheral layer 3 and then the bursting of the casing 1, with the formation of fragments.

Figure 3:
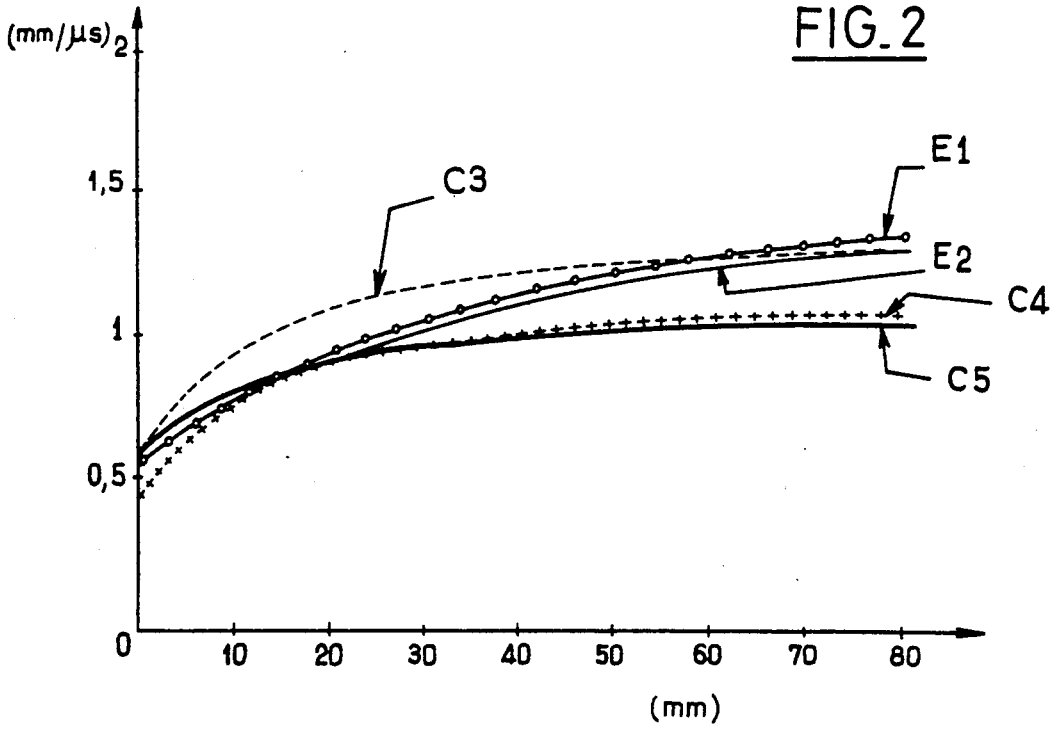
FIG. 3 shows comparative casing velocity curves, as a function of the radial expansion.

The progress of the velocity of lift of the metal casing was recorded as a function of the radial expansion, and this characterizes the degree of the required fragmentation effect, by virtue of a slit camera using the cylindrical lift experiment which is conventional for a person skilled in the art. The corresponding curve is shown in FIG. 3 (Curve E1).

Example 2

This example was carried out according to FIG. 2. The casing 11, 12.5 mm in thickness, is made of steel. Its outer diameter is 115 mm and its inner diameter 90 mm. Its length is 300 mm.

The casing 11 has a bottom, also of steel, with a thickness of 12.5 mm.

The abovementioned geometric characteristics of the star, D and d, are 50 mm and 34 mm respectively.

The plastic bonded explosives forming the internal layer 12 and the peripheral layer 13 are the same as in the case of Example 1.

This munition component was detonated and the fragmentation effect measured as in Example 1. The curve characterizing the degree of fragmentation effect obtained is shown in FIG. 3 (Curve E2).

COMPARATIVE EXAMPLES 3 to 5

EXPLOSIVE MUNITION COMPONENTS ACCORDING TO THE STATE OF THE ART

These examples are comparative examples carried out according to the state of the art solely for the purpose of showing the technical effect of the invention and the advantages stemming therefrom. They do no therefore come within the scope of the present invention.

In a casing which is identical with that employed in the case of Examples 1 and 2 according to the invention the following are produced:

According to Comparative Example 3, a single-composition charge made of plastic bonded explosive identical with that forming the internal layer of the twin-composition charge of Examples 1 and 2 according to the invention.

According to Comparative Example 4, a single-composition charge made of plastic bonded explosive identical with that forming the peripheral layer of the dual-composition charge of Examples 1 and 2 according to the invention.

According to Comparative Example 5 a dual-composition charge consisting of a cylindrical solid internal layer with a circular base surface of 60 mm diameter made of plastic bonded explosive identical with that forming the internal layer of the dual-composition charge of Examples 1 and 2 according to the invention, coated with an annular adjacent peripheral layer with an inner diameter of 60 mm and an outer diameter of 90 mm, made of plastic bonded explosive identical with that forming the peripheral layer of the dual-composition charge of Examples 1 and 2 according to the invention.

The explosive munition component according to this Comparative Example 5 therefore differs from the explosive munition components of Examples 1 and 2 according to the invention only in the geometry of the interface between the internal and peripheral layers of the dual-composition charge.

The munition components according to these 3 comparative examples were then detonated and the fragmentation effect obtained measured as in Examples 1 and 2. In the case of Comparative Examples 3 and 4, however, it was necessary to employ a PWG of 90-mm diameter instead of 76-mm as a main relay to initiate detonation. The curves characterizing the degree of fragmentation effect obtained are shown in FIG. 3 (Curve C3 in the case of the Comparative Example 3, Curve C4 in the case of the Comparative Example 4 and Curve C5 in the case of the Comparative Example 5).

The comparison, FIG. 3, of Curves E1 and E2 according to the invention and of Curves C3, C4 and C5 according to the state of the art reveals two particularly surprising and interesting results:

Comparison of Curves E1, E2 and C5 shows a considerable gain, of the order of 30%, in the fragmentation effect when the interface between the 2 layers has a star-shaped cross-section, all other parameters being otherwise identical.

Comparison of Curves E1, E2, C3 and C4 shows that the degree of fragmentation effect obtained according to the invention (Curves E1 and E2) is identical with that obtained with a single-composition charge produced with the effective plastic bonded explosive of the internal layer (Curve C3), whereas the single-composition charge produced with the less effective plastic bonded explosive of the peripheral layer provides a markedly smaller fragmentation effect (C4).

According to the invention, therefore, insofar as the fragmentation effect is concerned, everything behaves as if the charge consisted of an effective central explosive, whereas it has a detonation wave vulnerability which is considerably lower as a result of the presence of the low-sensitivity peripheral layer.

We claim:

1. An explosive munition element comprising a casing containing a dual composition explosive charge comprising (i) an internal layer comprising a plastic bonded explosive and (ii) an adjacent coaxial peripheral layer comprising a pyrotechnic composition less sensitive than said plastic bonded explosive of said internal layer, said plastic bonded explosive forming said internal layer being a filled polymer matrix, the filling of which contains at least one organic nitrate explosive, said pyrotechnic composition forming said peripheral layer being a filled polymer matrix, the filling of which contains at least one or both of an inorganic oxidizing agent and an organic nitrate explosive, the interface between said internal layer and said peripheral layer having a star-shaped cross-section.

2. The explosive munitions element of claim 1 wherein said internal layer and said peripheral layer are cylindrical.

3. The explosive munitions element of claim 1 wherein said star-shaped cross-section has 6 to 24 arms.

4. The explosive munitions element of claim 1 wherein said star-shaped cross-section is rigorously polygonal or has connecting grooves between arms thereof.

5. The explosive munitions element of claim 1 wherein said internal layer comprises a filled polyurethane or polyester polymer matrix, the filling of which contains more than 20 percent by weight of an organic nitrate explosive, the percentage being expressed relative to said plastic bonded explosive and said organic nitrate explosive being selected from the group consisting of Hexogen, Octogen, 5-oxo-3-nitro-1,2,4-triazole and mixtures thereof.

6. The explosive munitions element of claim 1 wherein the filling of said plastic bonded explosive forming said internal layer consists solely of an organic nitrate explosive.

7. The explosive munitions element of claim 1 wherein said pyrotechnic composition forming said peripheral layer is said plastic bonded explosive.

8. The explosive munitions element of claim 7 wherein said peripheral layer comprising said plastic bonded explosive comprises a filled polyurethane or polyester polymer matrix, the filling of which contains more than 20 percent by weight of an organic nitrate explosive, the percentage being expressed relative to said plastic bonded explosive and said organic nitrate explosive being selected from the group consisting of Hexogen, Octogen, pentrite, triaminotrinitrobenzene, nitroguanidine, 5-oxo-3-nitro-1,2,4-triazole and mixtures thereof.

9. The explosive munitions element of claim 8 wherein the filling of said plastic bonded explosive forming said peripheral layer consists solely of said organic nitrate explosive.

10. The explosive munitions element of claim 1 wherein said pyrotechnic composition forming said peripheral layer comprises a filled polyurethane or polyester polymer matrix, the filling of said matrix being an inorganic oxidizing agent and being free of an organic nitrate explosive.

11. The explosive munitions element of claim 10 wherein said filling of said matrix of said pyrotechnic composition forming said peripheral layer is an inorganic oxidizing agent selected from the group consisting of ammonium perchlorate, potassium perchlorate, ammonium nitrate, sodium nitrate and mixtures thereof.

12. The explosive munitions element of claim 10 wherein said filling of said matrix of said pyrotechnic composition forming said peripheral layer also contains a reducing metal.

13. The explosive munitions element of claim 10 wherein said pyrotechnic composition forming said peripheral layer consists of 10 to 40 percent by weight of a polyurethane or polyester polymer matrix, 0 to 40 percent by weight of a reducing metal, and 20 to 90 percent by weight of an inorganic oxidizing agent, the sum of the percentages being equal to 100.

14. A method for obtaining fragmentation of a casing housing a dual-composition explosive charge comprising (i) an internal layer comprising a plastic bonded explosive and (ii) an adjacent coaxial peripheral layer comprising a pyrotechnic composition less sensitive than said plastic bonded explosive of said internal layer, said plastic bonded explosive forming said internal layer being a filled polymer matrix, the filling of which contains at least one organic nitrate explosive, said pyrotechnic composition forming said peripheral layer being a filled polymer matrix, the filling of which contains at least one or both of an inorganic oxidizing agent and an organic nitrate explosive, the interface between said internal layer and said peripheral layer having a star-shaped cross-section, said method comprising releasing gas in said casing by detonating said plastic bonded explosive forming said internal layer of said explosive charge, whereby the detonation wave resulting from detonating said plastic bonded explosive initiates a reaction of the less sensitive pyrotechnic composition forming said peripheral layer, whereby the pressure of the released gas fragments said casing.

15. The method of claim 14 wherein the pyrotechnic composition forming said peripheral layer is a plastic bonded explosive, said peripheral layer also being detonated.

16. The method of claim 14 wherein the pyrotechnic composition forming said peripheral layer is an inorganic oxidizing agent and is free of an organic nitrate explosive and wherein said pyrotechnic composition is reacted without being detonated.

* * * * *